US005823709A

United States Patent [19]

Maher et al.

[11] Patent Number: 5,823,709

[45] Date of Patent: Oct. 20, 1998

[54] INTERCONNECTED BLOCK SYSTEM

[75] Inventors: Steve Maher, Orlando, Fla.; Mark Wayne, Alpharetta; Philip D. Egan, Atlanta, both of Ga.

[73] Assignee: The Tensar Corporation, Atlanta, Ga.

[21] Appl. No.: 730,600

[22] Filed: Oct. 15, 1996

Related U.S. Application Data

[63] Continuation-in-part of Ser. No. 677,189, Jul. 9, 1996, abandoned.

[51] Int. Cl.[6] ..... E02B 3/14

[52] U.S. Cl. ..... 405/20; 405/16

[58] Field of Search ..... 405/15–20, 258; 52/386, 388; 404/35, 40, 18, 71, 73, 70, 45

[56] References Cited

U.S. PATENT DOCUMENTS

| | | | |
|---|---|---|---|
| 869,566 | 10/1907 | Hawkes | 405/20 |
| 1,071,091 | 8/1913 | Rogers | 405/20 |
| 2,092,183 | 9/1937 | Rehfeld | 405/19 |
| 3,597,928 | 8/1971 | Pilaar . | |
| 3,601,015 | 8/1971 | Kilstofte | 404/45 |
| 3,702,093 | 11/1972 | Van de Loock et al. | 404/70 |
| 3,922,865 | 12/1975 | Nijdam . | |
| 4,370,075 | 1/1983 | Scales | 405/20 |
| 4,374,798 | 2/1983 | Mercer . | |
| 4,417,828 | 11/1983 | de Winter . | |
| 4,449,847 | 5/1984 | Scales et al. . | |
| 4,502,815 | 3/1985 | Scales et al. . | |
| 4,530,622 | 7/1985 | Mercer . | |
| 4,726,708 | 2/1988 | Papetti | 405/19 |
| 4,815,892 | 3/1989 | Martin . | |
| 5,108,222 | 4/1992 | Jansson et al. . | |
| 5,273,804 | 12/1993 | Brian et al. . | |
| 5,342,141 | 8/1994 | Close | 52/386 |
| 5,540,525 | 7/1996 | Miller et al. . | |
| 5,595,460 | 1/1997 | Miller et al. . | |

FOREIGN PATENT DOCUMENTS

| | | |
|---|---|---|
| 0608036 | 7/1994 | European Pat. Off. . |

*Primary Examiner*—Tamara L. Graysay
*Assistant Examiner*—Frederick L. Lagman
*Attorney, Agent, or Firm*—Jacobson, Price, Holman & Stern, PLLC

[57] ABSTRACT

An interconnected block system including a plurality of staggered rows of block members formed of concrete or the like secured to the upper surface only of an underlying, interconnecting, grid-like, matrix sheet. In one embodiment, a plurality of connector elements are connected to the matrix material preferably by bodkin connections to form one or a multiplicity of openings or apertures above the upper surface of the matrix sheet for reception of the block-forming material. The block members are cast on top of the matrix sheet material to capture the connector elements which provides a mechanical interlock between the block member and the matrix. The matrix sheet material preferably includes a layer of geotextile bonded on an opposite side from the block members. An alternate embodiment provides a strip or mat to underly the matrix sheet with a plurality of projections upstanding therefrom and passing through the matrix sheet. Free end portions of the projections are configured to retain block-forming material cast to surround the projections. Multiple layers of interconnected blocks may be made without waiting for the concrete to set by using preformed mold elements which are left in place in the final product and which act to support superimposed layers as they are cast. A sleeve may be secured to a leading edge of the matrix sheet to receive and retain a sand-filled tube or the like to prevent lifting of the matrix sheet by wave action or the like.

41 Claims, 10 Drawing Sheets

INTERCONNECTED BLOCK SYSTEM

This application is a continuation-in-part of application Ser. No. 08/677,189, filed Jul. 9, 1996, now abandoned the subject matter of which is incorporated herein in its entirety by reference.

FIELD OF THE INVENTION

This invention relates to an interconnected block system including concrete or concrete-like blocks cast and mechanically interconnected on top of a section of a grid-like geosynthetic material or geocomposite for use, inter alia, as revetments, pavements, channel linings, and other special lining systems in erosion control, waste containment and paving applications. In addition, the interconnected block system can be combined with a sand filled tube to prevent lifting of a leading edge of a section of the grid-like geosynthetic material or geocomposite.

BACKGROUND OF THE INVENTION

A major application of the interconnected block system of the instant invention is to minimize or prevent shoreline erosion from fast flowing water. Such erosion is commonly seen in ocean or seaside environments where wave action can cause significant damage. Similar problems exist where water flowing quickly along a river produces erosion of the river banks. Revetments in the nature of an interconnected block system according to this invention provide excellent erosion protection in such environments while offering other advantages to be discussed hereinafter.

Another area where interconnected block systems, sometimes referred to as geomats or geomattresses, find utility is the capping of dredge spoil domes. Harbors throughout the United States require periodic dredging to maintain sufficient draft depth for shipping. The dredge spoil produced by this operation is loaded into bottom dump barges and transported out to sea to underwater dredge disposal sites which have been identified by the U.S. Army Corps of Engineers.

At the disposal site the dredge spoil material is simply dumped from the barge and allowed to settle to the bottom of the sea at a depth ranging from 150 to 200 feet. This procedure creates large domes of dredge spoil material which range from 1000 to 2300 feet in diameter. The dredge spoil material oftentimes includes contaminated material which is potentially harmful to the environment. A solution is presently being sought to develop ways of capping these domes to prevent migration of the contaminated material to the surrounding ocean beds and water.

One proposed solution for this problem is the use of a concrete mass to cap the domes of contaminated material. There is currently an interconnected concrete block revetment system on the market as described in U.S. Pat. No. 4,370,075, the subject matter of which is incorporated herein in its entirety by reference. In this system, a plurality of individual concrete blocks are cast with horizontally and vertically oriented holes. After the blocks have cured, they are then moved to an assembly area where they are arranged in a selected configuration by hand and steel cables are threaded through the horizontally oriented holes to tie the entire panel together. The panels may then be lifted from the ends of the steel cables by a sling system and positioned for use. The pre-cast vertically oriented holes may be filled with soil to allow for revegetation.

The cables passing through the horizontally oriented preformed holes permit relative movement of the individual blocks. Repeated abrasion resulting from wave action may eventually cause failure of the cables. While the primary function of the cable system is for lifting and placement of the interconnected blocks, destruction of this matrix is believed to significantly reduce the effectiveness of the revetment.

An alternate approach is disclosed in U.S. Pat. Nos. 4,449,847 and 4,502,815, the subject matter of which are also incorporated herein in their entirety by reference. Here, a high strength fabric bag is positioned for use and pumped full of concrete grout. This system is effectively limited to revetment applications and cannot be economically placed in deep water.

Each of these prior art techniques either require placement in situ or by lifting small pre-assembled units. As a result, the size of such installations is relatively small, on the order of, perhaps, forty feet long by about eight feet wide, limiting the use of these systems in efficiently and effectively capping the domes of contaminated dredge material.

More recently, the use of an articulated mat comprising a geogrid embedded in discrete concrete castings has been described in U.S. Pat. No. 5,108,222, the subject matter of which is incorporated herein in its entirety by reference. This system is believed to be severely limited due to the strength of the proposed interconnecting matrix.

An improved approach is disclosed in copending, commonly assigned U.S. patent application Ser. No. 08/455,684 filed May 31, 1995, the subject matter of which is also incorporated herein in its entirety by reference. In the preferred embodiment of this application, a geomattress is formed by placing sections of a uniaxially oriented grid-like sheet material across a plurality of spaced, staggered forms in which the bottom portions of concrete panels have been cast. The uniaxially oriented material includes thickened bars interconnected by oriented strands and the upper portions of the panels are cast to secure at least one such bar to each panel thereby providing a strengthened articulated matrix for interconnecting and supporting the concrete panels during lifting, placement and use of the geomattress.

The aforementioned techniques for producing articulated mats or geomattresses require the concrete blocks to be cast in two separate steps in order for portions of the concrete to pass through the openings of the grid-like matrix. Such a process is time consuming and difficult to accomplish at a construction site. Accordingly, the geomattress must first be formed, then lifted, and transported to a final destination.

Additionally, the need to cast the concrete blocks on both sides of the grid-like matrix so the concrete can pass through the openings and embed the grid material precludes the use of a geocomposite having a geotextile facing adapted for contact with the underlying soil or base material, an important structural characteristic to provide erosion protection, drainage, filtration and separation. Even separately laying a geotextile beneath an interconnected block system of the prior art, a time consuming and labor intensive process, does not adequately and uniformly secure the geotextile in place, limiting the effectiveness of such systems for many applications.

Thus, the prior art interconnected block systems each have limitations in manufacture or use, depending on the particular application for which the products are intended.

SUMMARY OF THE INVENTION

It is a primary object of the present invention to provide an interconnected block system for diverse applications including erosion control, waste containment and paving, which is free of the foregoing and other disadvantages attendant to prior art approaches currently in use or proposed for use.

Another object of this invention is the provision of an interconnected block revetment system which is relatively inexpensive to manufacture and use, yet highly versatile and readily adapted to different end uses.

Still a further object of the instant inventive concepts is to provide a method for making an interconnected block system which can be cast in-place, or on-site, or at an off-site prefabrication facility.

It is still another object of the present invention to secure a sand-filled tube to a leading edge of a grid-like material to which blocks have been secured to anchor the leading edge against uplifting forces, such as wave action.

Yet another object of this invention is the production of a geomattress or the like in which the interconnecting matrix for a plurality of blocks formed of concrete or the like may be formed of a grid-like material alone, such as an integrally formed uniaxially or biaxially oriented structural geogrid or a bonded composite open mesh structural textile, or a geocomposite comprising such a grid-like material bonded directly to a geotextile or a drainage net material. In this manner, the grid-like material may perform certain functions, including configuration or spacing of the blocks, a durable interconnection of the blocks longitudinally and laterally while providing a polymeric carriage for lifting and placement of the mat of blocks, and the geotextile or drainage net may perform other functions, including separation, filtration and improved erosion control. The use of a geocomposite matrix integral to the system provides the unique capacity to maintain intimate contact of a geotextile with the underlying soil. Moreover, the flexural rigidity of the geocomposite matrix insures this intimate contact, even between the blocks, to provide excellent erosion protection, drainage, filtration and separation.

These and other objects of this invention are achieved by a unique mechanical interconnection which enables a plurality of spaced blocks formed of concrete or the like to be effectively secured to only one side of an underlying sheet or matrix, whether the interconnecting matrix is an integral biaxially or uniaxially oriented structural geogrid or a bonded composite open mesh structural textile alone, or such a grid-like material uniformly bonded to a geotextile or a drainage net material for improved structural and functional properties.

According to the initial embodiments of this invention, one or more upstanding connector elements are formed on the upper surface of the interconnecting matrix each of which defines a cavity or reservoir, or a grid-like array of apertures, or a combination of such elements, for reception of block-forming material to mechanically lock a plurality of blocks cast in a pre-selected pattern on the surface of the matrix.

As will be discussed in more detail hereinafter, the connector elements are preferably in the form of small inverted U- or V-shaped "sleds", or hoops, each of which is fixedly secured to the interconnecting matrix to extend upwardly from one face of the matrix. The connector elements themselves are preferably formed of a grid-like material such as short sections of a uniaxially or biaxially oriented integral structural geogrid or a bonded composite open mesh structural textile. Such materials comprise openings or apertures defined by their interconnected strands extending at an angle to, and spaced from, the upper surface of the matrix sheet through which the cast block-forming material may pass to secure the resultant blocks to the underlying interconnecting matrix.

Further, the very nature of the "sled" or hoop construction, even if formed of imperforate sheet material, forms an opening or cavity which extends generally parallel to the upper surface of the matrix sheet and functions as a reservoir for reception of block-forming material to integrate the cast blocks with the interconnecting matrix in a secure manner.

Alternatively, the connector elements may take the form of elongated strips or mats having a plurality of fingers extending from one surface thereof. The free ends of the fingers may include serrations, barbs, balls, hooks, or even openings, so that, when the fingers project through a matrix to an extent limited by the strips contacting the undersurface of the matrix, the free ends of the fingers are captured within a block-forming material cast on the upper surface of the matrix to secure the thus-formed blocks to the matrix material.

The term "grid-like sheet material" as used herein and the appended claims is to be understood as encompassing any continuous sheet material having one or more apertures formed therein in any conventional manner. Depending upon the particular application, preferred materials for either the underlying matrix of the interconnected block system of the instant invention, or the connector elements or "sleds" themselves may be uniaxially or biaxially oriented integral structural geogrids or bonded composite open mesh structural textiles. The description of preferred forms of both such materials are found in co-pending, commonly assigned U.S. patent application Ser. No. 08/643,182 filed May 9, 1996, the subject matter of which is incorporated herein in its entirety by reference. The preferred form of uniaxially or biaxially oriented integral structural geogrids are commercially available from The Tensar Corporation of Atlanta, Georgia ("Tensar") and are made by the process disclosed in U.S. Pat. No. 4,374,798, the subject matter of which is also incorporated herein in its entirety by reference.

A high strength integral geogrid may be formed by stretching an apertured plastic sheet material. Utilizing the uniaxial techniques, a multiplicity of molecularly-oriented elongated strands and transversely extending bars which are substantially unoriented or less-oriented than the strands are formed in a sheet of high density polyethylene, although other polymer materials may be used in lieu thereof. The strands and bars together define a multiplicity of grid openings. With biaxial stretching, the bars are also formed into oriented strands.

As indicated, particularly for the underlying interconnecting matrix sheet, the preferred grid-like sheet material is a uniaxially-oriented geogrid material. However, biaxial geogrids or grid materials that have been made by different techniques such as woven, knitted or netted grid materials formed of various polymers including the polyolefins, polyamides, polyesters and the like or fiberglass, may be used. In fact, any grid-like sheet materials, including steel (welded wire) grids capable of being secured to concrete blocks of the instant invention in the manner disclosed herein are suitable. Also, for most applications, bonded composite open mesh structural textiles, such as disclosed in the aforementioned application Ser. No. 08/643,182 may be useful as the underlying, interconnecting matrix sheet material, or for the formation of the connector elements.

In the production of large geomattresses or the like, gaps extending along at least one longitudinal axis of the block system of this invention are formed between adjacent rows of blocks to permit the same to be bent along that axis for lifting, rolling or folding of the mattress. Thus, an important feature of the material to be used as the interconnecting underlying matrix is that it allows bending along these gaps and has sufficient strength to permit the interconnected block system or mattress to be lifted, with the grid-like sheet of material supporting the weight of the plurality of concrete blocks attached thereto.

It is to be understood that, while reference is made throughout to the preferred form of the interconnecting matrix sheet as "grid-like", the matrix material may have solid portions, particularly in the gaps intermediate the concrete blocks. In fact, when producing an interconnected block system using the aforementioned alternative form of connector elements comprising strips of material with a plurality of upstanding fingers which protrude through the matrix, the matrix may be substantially imperforate except for openings through which the fingers of the connector elements may pass, these opening being pre-formed or produced by the penetration of the fingers, if the fingers of the connector elements are sufficiently rigid. Thus, the term "grid-like" is intended to encompass such a matrix as well.

The initial form of connector elements discussed above may also be made of materials which are partially or entirely imperforate, so long as they can be secured to the interconnecting matrix so as to extend from one surface thereof and define openings or reservoirs for reception of the block-forming material.

With each of the embodiments of this invention, the concrete blocks are secured to only one side of the underlying interconnecting sheet material. In the initially discussed embodiments, one or more small pieces, preferably of grid-like sheet material, of an overall length and width less than the to-be-formed block are secured to the matrix to form the aforementioned "sleds" or hoops. A preferred connection between these elements is referred to as a "bodkin" and is formed by utilizing a grid-like material for the connector elements and by transversely bending strands of the connector-forming grid-like sheet material to form loops which are passed through the openings between the strands of the underlying grid-like sheet material forming the matrix or the upper layer of the matrix, and then engaging a connecting member or rod, such as ⅜ inch HDPE bodkin connector bar or the like, through the loops to prevent the loops from being withdrawn. Such a connection is well known and shown in U.S. Pat. No. 4,530,622, the subject matter of which is incorporated herein in its entirety by reference. In this manner, opposite ends or edge portions of the connector-forming material may be anchored to the elongated grid-like matrix to project from one side thereof in a U- or V-shaped configuration.

Alternatively, a small piece of grid-like sheet material or the like can be formed into a circular hoop and connected by a single bodkin connector bar to the underlying grid-like sheet material of the matrix as discussed in more detail hereinafter.

A casting form is then placed around the projecting portion of each of the connector elements and concrete or a similar material is cast, whereby the blocks formed thereby are mechanically secured to one surface of the interconnecting matrix by engagement of the block-forming material in the cavity defined by the "sled" or hoop and the matrix and/or by integration of the block-forming material through the apertures or openings in the grid-like material of the connector elements.

With the alternative embodiments, the fingers extend through the matrix and include terminal or free end portions configured to be captured within the concrete or the like blocks cast thereon.

Because there is no need, utilizing any of the embodiments of the instant inventive concepts, for the block-forming material to pass through openings in the underlying grid-like sheet material matrix, as with prior constructions, it is possible, and desirable as an aid to prevent erosion, for the underlying matrix to comprise a geocomposite, including a geogrid and a geotextile bonded at least to the nodes of the geogrid. Alternatively, a drainage composite such as shown, for example, in U.S. Pat. No. 4,815,892, the subject matter of which is incorporated herein in its entirety by reference, may be bonded to the underside of the grid-like sheet material matrix. In this instance, the sheet material matrix interconnecting the concrete blocks may include a geogrid, a geotextile, a drainage net and another layer of geotextile.

When casting concrete in situ, it is common to prepare a wooden form which is removed when the concrete has set. Such a procedure is time consuming and labor intensive. Leaving wooden forma in place in the environment for which the interconnected block system of the instant invention is intended would result in the wood or nails eventually disintegrating, the wooden elements floating free of the matrix and thereby polluting the environment.

Therefore, this invention contemplates the use of a casting form that will not deteriorate in water and may be left in place to form part of the interconnected block system. Thus, the casting form may be made of dry cast concrete, stiffened thermoplastic plastic, stiff thermoset plastic or brick, for example. Due to the crush resistance of the casting forms, it is possible to cast a layer of blocks on a geocomposite matrix, lay a second geocomposite matrix over the first layer and locate additional casting forms over the casting forms in the first layer as the blocks of the first layer cure. Additional pourings of concrete in the casting forms in the thus formed second layer can then be made. This process is repeated to form multiple layers of blocks with minimal casting space requirements.

The use of a composite material as the interconnecting matrix provides the combined benefits of the geogrid and the geotextile or drainage composite in an integral form. The flexural rigidity of the grid composite maintains intimate contact of a filter material, the geotextile, with the underlying soil maximizing erosion protection, drainage, filtration and separation.

Although the preferred embodiments of the instant inventive concepts bond a geotextile or a drainage composite to the underside of a geogrid or the like, for certain applications the geotextile, or even a drainage composite can be bonded to the upper surface of the geogrid. It would then be necessary to provide apertures or openings through the geotextile or drainage composite if the "sled" or hoop block-connectors are to be secured to the matrix, particularly if bodkin connections are utilized to provide this mechanical interlock.

If the anticipated use of the block system is expected to encounter forces along its edges which may tend to overturn or roll-up the block system, the system may be modified to overcome this problem. A tube may be secured to an edge of the system which would prevent such failures. The tube may be made of a woven geotextile sewn into an appropriate configuration with ports for injection of a sand/water slurry. The tube may be anchored to the block system by a grid hoop, either integral with the matrix of the block system or of a separate material, connected by a bodkin connection to the underlying matrix so the tube will not drift.

While the dimensions and configuration of the interconnected block system of this invention are variable depending upon the application, a typical alignment of blocks incorporating the teachings of the present invention would include rectangular blocks approximately 7.5" by approximately 15.5", 1.75 to 4" thick. Alternatively, circular blocks of approximately a 12" diameter may be used. Also, special shapes may be used to further promote the retention of soil or similar materials and to promote the capture of sediment.

In either event, the blocks are preferably arranged in staggered rows, with an offset of each block between adjacent rows of approximately 50%. The staggered arrangement of adjacent rows interrupts flow-through of water, for example at the shore line of an ocean, to prevent straight line erosion between blocks by the return of breaking wave water to the ocean.

The foregoing and other objects of the instant invention, as well as many other attendant advantages, will become more readily apparent when reference is made to the following description taken in conjunction with the accompanying drawings.

DETAILED DESCRIPTION OF THE PREFERRED EMBODIMENTS

Figure 1:
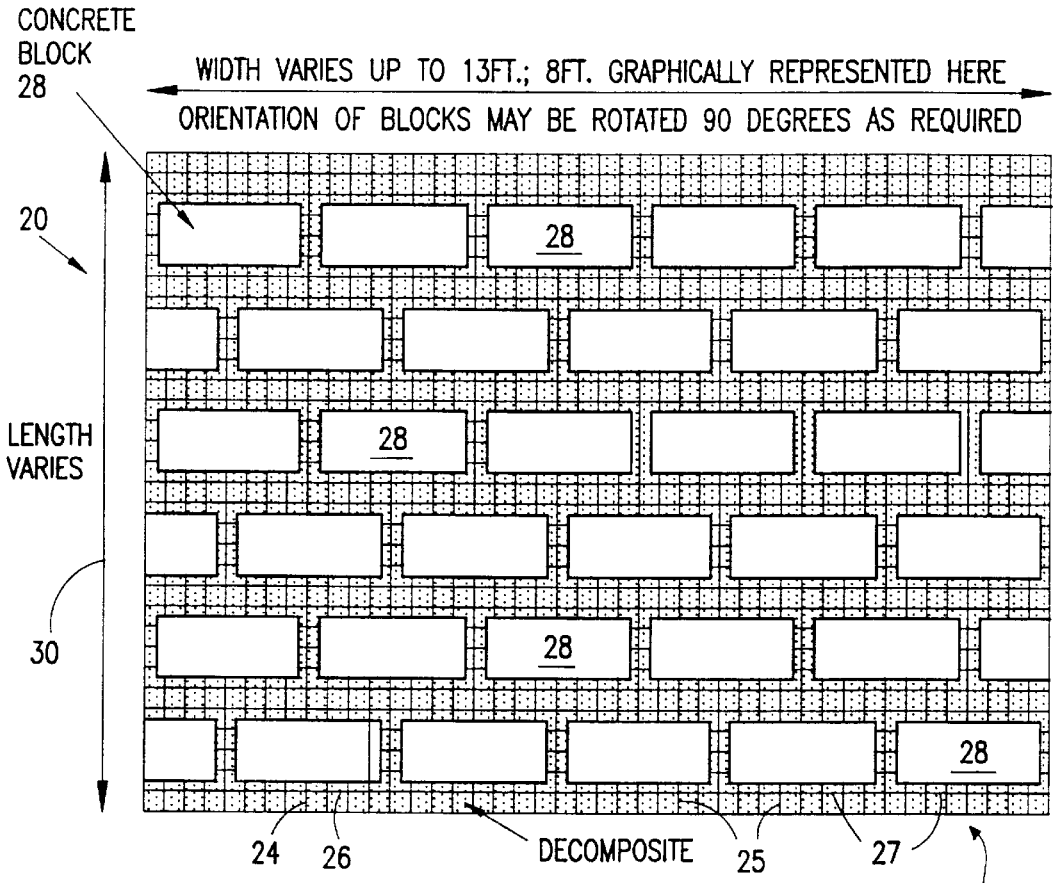
FIG. 1 is a plan view of a plurality of blocks interconnected by an underlying sheet material matrix according to one embodiment of this invention.

In describing preferred embodiments of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

With reference to the drawings, in general, and to FIGS. 1 through 4, in particular, one form of an interconnected block system or mat or mattress embodying the teachings of the subject invention is generally designated as 20, and includes an underlying, interconnecting, sheet material matrix 22 carrying a plurality of block members 28 formed of concrete or a similar material, rectangular blocks being shown in FIG. 1, although other geometric shapes are equally applicable to this invention.

While reference is made herein to the use of concrete as the preferred block-forming material, it is to be understood that this term is intended to include other similar materials, whether cementitious or not, including, particularly, well known thermosetting polymeric compositions which form concrete-like panels or blocks when solidified.

The matrix 22 includes a grid-like material formed by a plurality of parallel strands 24 interconnected at nodes or junctions 25 to parallel strands or bars 26 extending perpendicular to strands 24 to define therebetween a multiplicity of apertures 27. As indicated above, the grid-like sheet material of the matrix 22 may be an integrally formed uniaxially or biaxially oriented structural geogrid, a bonded composite open mesh structural textile, or for that matter, any grid-like material capable of supporting the plurality of blocks to which the connector elements may be mechanically secured. However, the preferred matrix material for large installations includes an integrally formed, uniaxially oriented, structural geogrid where the bars 26 are unoriented or less oriented and, thus, thicker than, the strands 24 for improved strength.

A plurality of concrete blocks 28 are secured to the matrix 22 in parallel rows as shown in FIG. 1. Between each row of blocks is a gap 32 which allows bending of the matrix 22 between the blocks to permit the section to assume a non-planar condition for lifting and in use. When the gap between adjacent rows of blocks is large enough, the section may be folded upon itself for lifting and transporting.

The blocks in juxtaposed rows are preferably staggered or offset by 50% so that water flowing in the direction of arrow 30 would be interrupted to minimize erosion from straight line flow between the blocks.

If multiple sections of matrix material are to be interconnected to form an enlarged mattress, it is contemplated that some of the blocks 28 could be positioned and dimensioned to span adjacent sections so as to integrate the underlying matrix material. In any event, the spacing between juxtaposed blocks 28 is related to the dimensions of the matrix material so as to uniformly position the blocks and balance the system. Likewise, the size and shape of the blocks are site and application specific and can be widely varied without departing from the instant inventive concepts.

For example, FIG. 1 depicts a block width that may be used for lining an ocean shoreline. Other block widths may be used for a boat ramp or for a channel lining application. The width and thickness of each concrete block are predicated on the desired coverage, the slope angle and the energy associated with the waves or flow velocity of the water which the concrete system would have to withstand and, therefore, these dimensions can vary. The length of each block can vary and may be designed to accommodate the commercially available grid-like sheets of material used to support and interconnect the blocks in the system.

Figure 2:
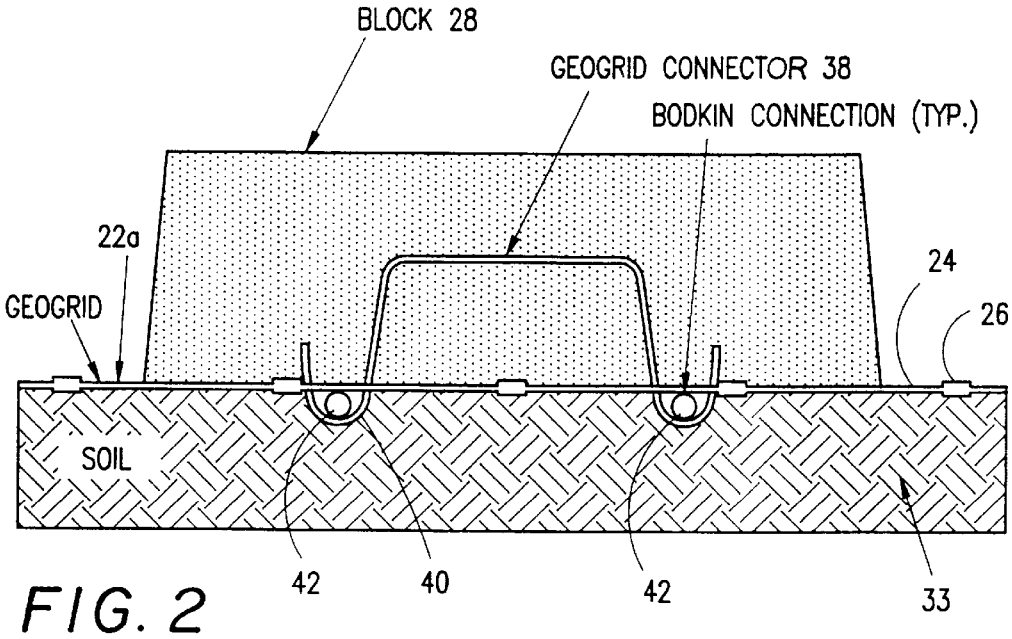
FIG. 2 is a schematic cross-sectional view illustrating the interconnection of a block to a matrix formed of geogrid or the like, using one form of mechanical connector element or "sled" according to this invention.
Figure 3:
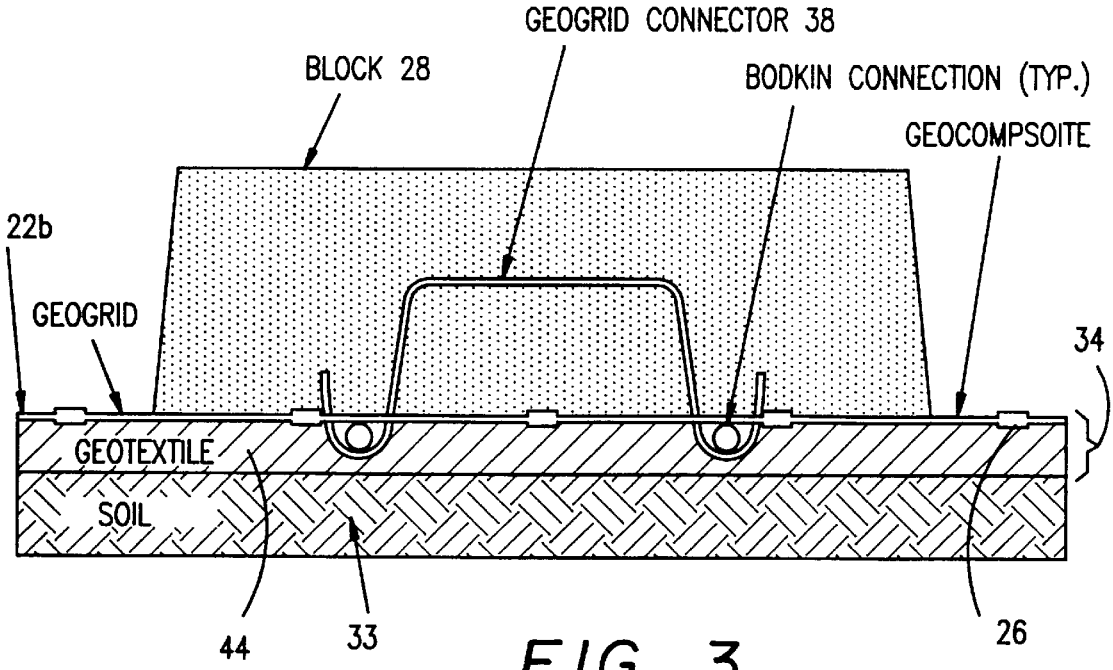
FIG. 3 is a similar schematic view showing the use of an underlying sheet material matrix formed of a geocomposite including a geogrid bonded to a geotextile material according to a preferred embodiment of this invention.
Figure 4:
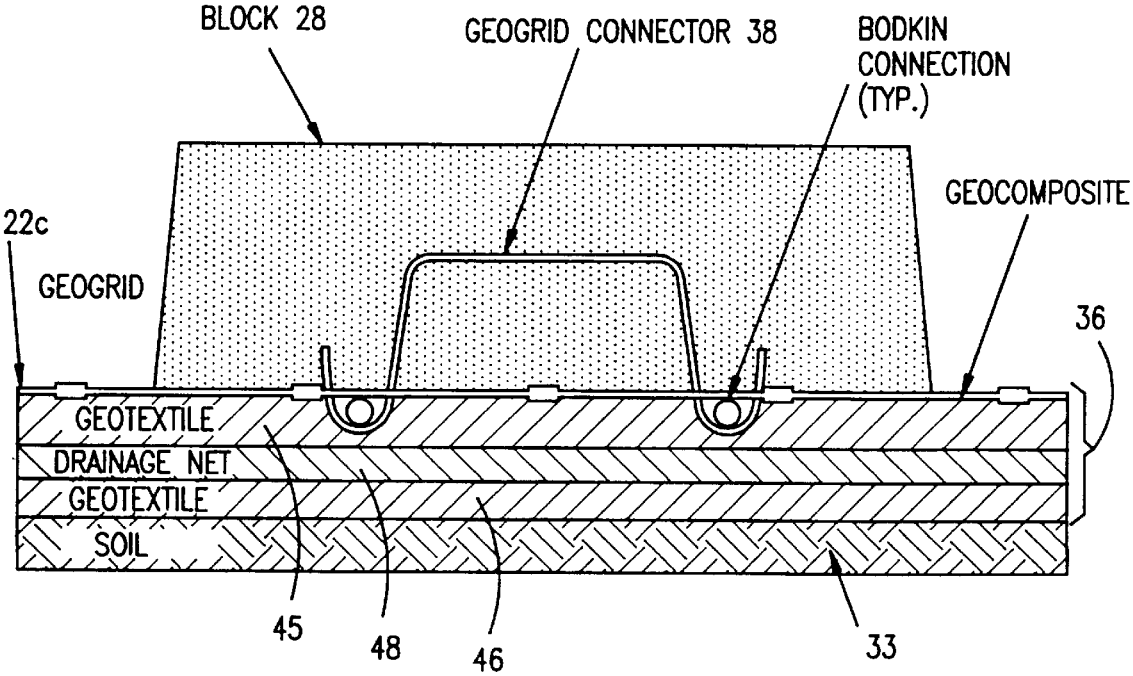
FIG. 4 illustrates a modified supporting geocomposite matrix including a double-sided drainage composite bonded to a geogrid, and comprising geotextile, a drainage net and an underlying layer of another geotextile.

In FIGS. 2 through 4, a bodkin type of mechanical connection between different matrices and a connector element according to this invention is illustrated. In FIG. 2, the underlying, interconnecting matrix 22*a* is simply a grid-like sheet material, such as an integral uniaxially oriented structural geogrid or the like, in direct contact with the soil 33. In FIG. 3, the matrix 22*b* is a geocomposite 34 including a geogrid or the like bonded to a geotextile. In FIG. 4, the matrix 22*c* is a geocomposite including a geogrid or the like bonded to a double-sided drainage composite.

The connector elements 38 are preferably formed of a grid-like material which may also be formed, for example, of an integral structural geogrid, either uniaxially or biaxially oriented, or a bonded composite open mesh geotextile. The mechanical engagement between the matrix 22 and the connector element 38 may take any form, but a bodkin connection, as discussed above, is preferred. With such a construction, the grid-like material of the connector element 38 is bent so that, at opposite ends, its strands 40 form a loop which is passed through the openings in the top surface of the grid-like material of the matrix as seen in FIGS. 2–4. The connector elements 38 are secured in place by connection or bodkin bars 42 which pass through the loops beneath the grid-like material of the matrix to preclude the connector elements from being disengaged.

Casting forms (not shown in these Figures) are positioned about each of the upstanding connector elements 38 and concrete or the like is cast in place to capture the connector elements 38 within the thus-formed blocks 28 and thereby mechanically connect the blocks 28 to the upper surface of the matrix 22.

The strength of the mechanical connection of the blocks 28 to the matrix 22 is provided by the engagement of the concrete-like material of the blocks through openings, apertures or cavities formed by the connector elements 38 alone, or in association with the upper surface of the matrix 22, with no need for the block-forming material to pass through or engage in the apertures of the grid-like material of the matrix. This construction permits the matrix to include more than just a geogrid or the like, enabling the use of a geocomposite matrix such as shown at 34 in FIG. 3 wherein a grid-like material is bonded to a geotextile 44 either at the bars 26 of the geogrid section 22 when uniaxial geogrid is used or at the nodes 25 formed between the intersections of the bars and the strands when a biaxial geogrid is part of the composite 34. Likewise, a geocomposite matrix such as shown at 36 in FIG. 4 may include a double-sided drainage net comprising upper and lower geotextiles 45, 46 with an intermediate layer of geonet 48 sandwiched therebetween.

Geocomposites such as illustrated at 34 in FIG. 3 are available from Tensar as their GC3320 laminate and drainage composites such as illustrated at 36 in FIG. 4 are available from Tensar as their DC 6205 laminate.

As indicated, since there is no need for the block-forming material to pass through the openings of the matrix material, a geotextile or drainage composite can form the matrix or the upper layer of the matrix, so long as means are provided to secure the connector elements 38 thereto.

In any event, the ability to integrate a geotextile into the matrix using the construction of this invention avoids the need to separately position a geotextile at the work site as is customary to minimize erosion of the soil below a geomattress or the like.

Several different embodiments of the construction of the connector element are illustrated in FIGS. 5–10. In each instance a geocomposite matrix of the type shown at 34 in FIG. 3 is illustrated, but it is understood that any of the various matrices disclosed herein may be substituted therefor.

Figure 5:
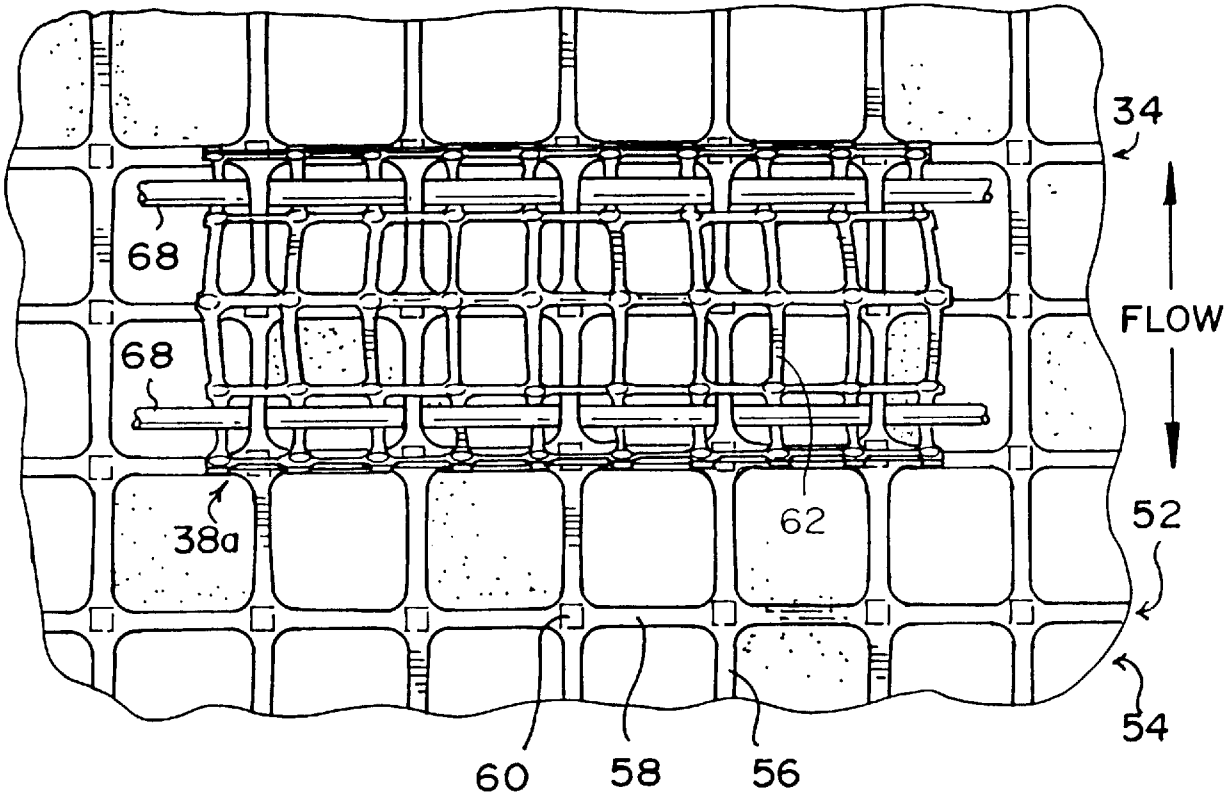
FIG. 5 is a plan view of one form of connector "sled" according to this invention secured to the geogrid layer of a geocomposite matrix prior to casting a block thereon, the connector element being formed of a biaxially oriented integral structural geogrid and being connected to the matrix by a pair of bodkin connector bars.
Figure 6:
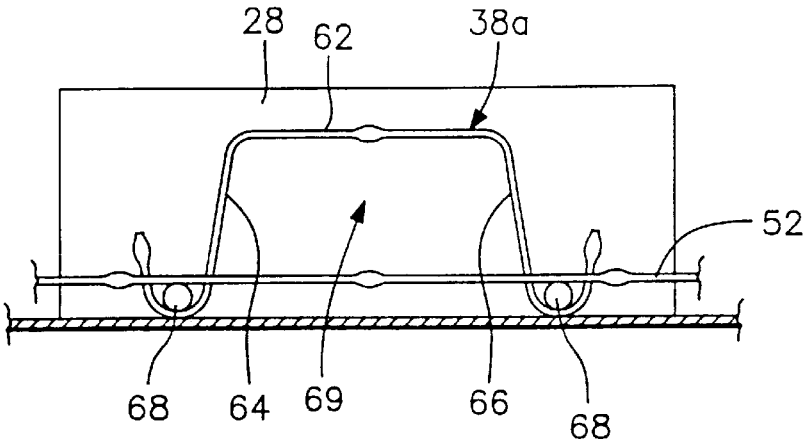
FIG. 6 is a side view of the connector arrangement shown in FIG. 5, with finished blocks shown behind the connector element.

In FIGS. 5 and 6, a connector element 38*a* is shown for securing a block 28 to the geocomposite matrix 34 which comprises an integral biaxially oriented structural geogrid 52 having a geotextile 54 bonded thereto. The geogrid 52 includes strands 56 arranged perpendicular to strands 58 intersecting at nodes 60.

In this embodiment, as seen particularly in FIG. 6, the connector element 38*a* is made of a small section of biaxial geogrid 62 having opposite end portions 64 and 66 projecting above the upper surface of the geogrid 52 of the matrix geocomposite 34. Loops formed of the geogrid 62 pass through the openings in the geogrid 52 of the matrix and receive bodkin connector bars 68 to lock the connector element 38*a* to the geocomposite 34. As shown in FIG. 6, the geogrid 52 and geotextile 56 of the matrix may deflect slightly so as to accommodate the connector bars 68 below the geogrid 52 and above the geotextile 54.

Projecting above the upper surface of the geocomposite 34 is a U-shaped portion 68 of the geogrid connector element 52. When a block 28 is cast (as shown behind the connector element 38*a* in FIG. 6), the block-forming material captures the portions of the geogrid connector 62 projecting above the upper surface of the matrix, namely ends, 64, 66 and U-shaped portion 68, and thereby integrates the block 28 with the geocomposite 34.

While, to a limited extent, the block-forming material is secured to the connector element 38*a*, and thus to the geocomposite 34, by frictional engagement with the surface of the material of the connector element and the upper surface of the geocomposite, for most applications such attachment would be inadequate. However, in the embodiment of FIGS. 5 and 6, the block-forming material can pass through the apertures of the geogrid 62 to surround and capture the strands of the connector element 38*a*. Moreover, a large cavity or reservoir 69 is formed between the lower surfaces of the connector element 38*a* and the upper surfaces of the geocomposite 34 which enables the block-forming material to capture the connector element 38*a* to secure the block to the geocomposite 34, even if the connector element and the matrix were, for all intents and purposes, imperforate.

Figure 8:
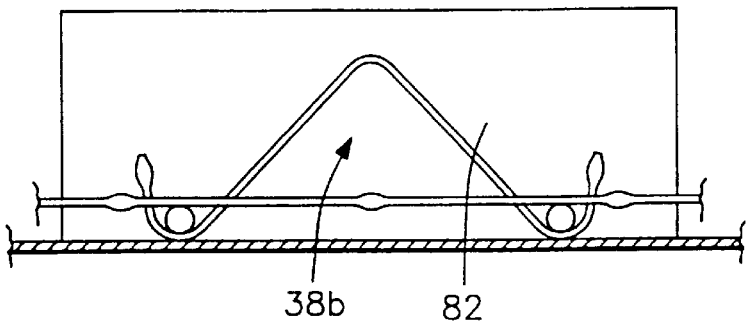
FIG. 8 is a side view of the connector arrangement shown in FIG. 7.
Figure 7:
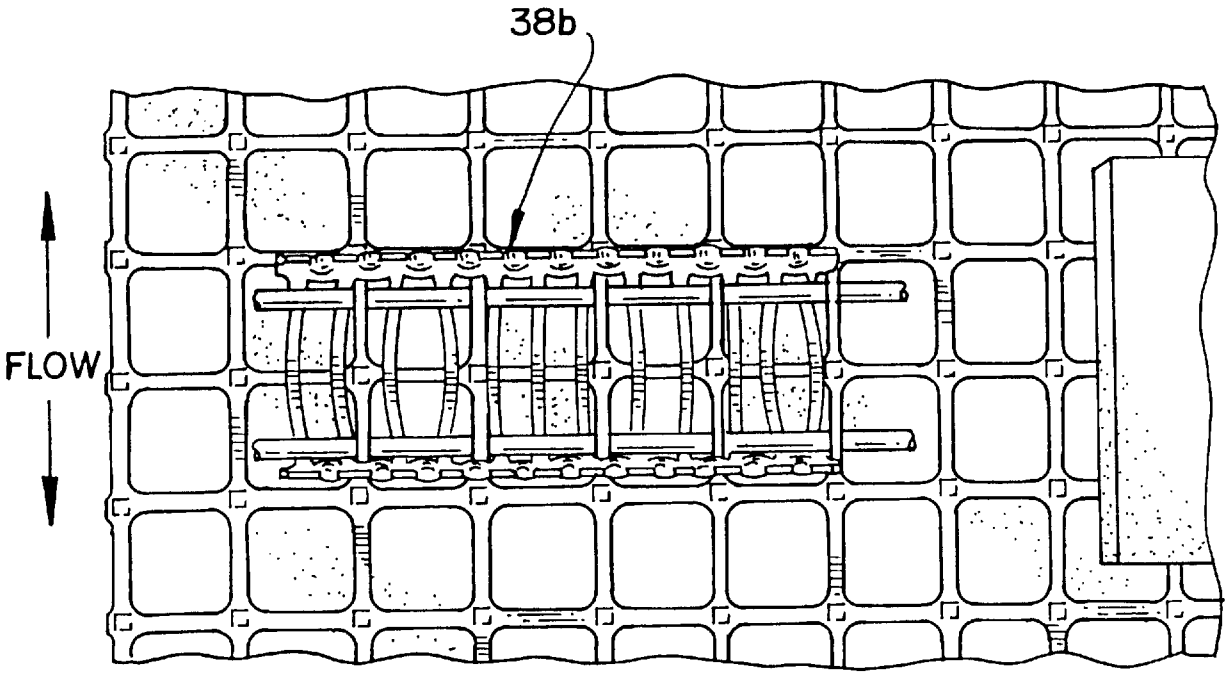
FIG. 7 is a plan view similar to FIG. 5 of an embodiment of the instant invention wherein the connector element is formed of a modified integral structural geogrid.

In the alternative embodiment as shown in FIGS. 7 and 8, the geocomposite 34 is engaged with a section of a somewhat different configuration of biaxially oriented geogrid connector element 38*b* which provides a centrally located, generally V-shaped, portion 82 projecting above the upper surface of the geocomposite 34, rather than the U-shaped connecting portion 68 of the previous embodiment. Obviously, the type of material used to form the connector element can be varied significantly without departing from the instant inventive concepts.

Figure 10:
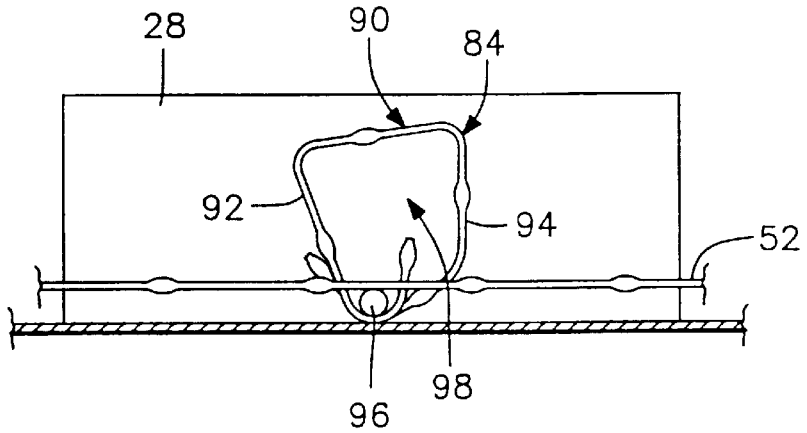
FIG. 10 is a side view of the hoop connector arrangement shown in FIG. 9.
Figure 9:
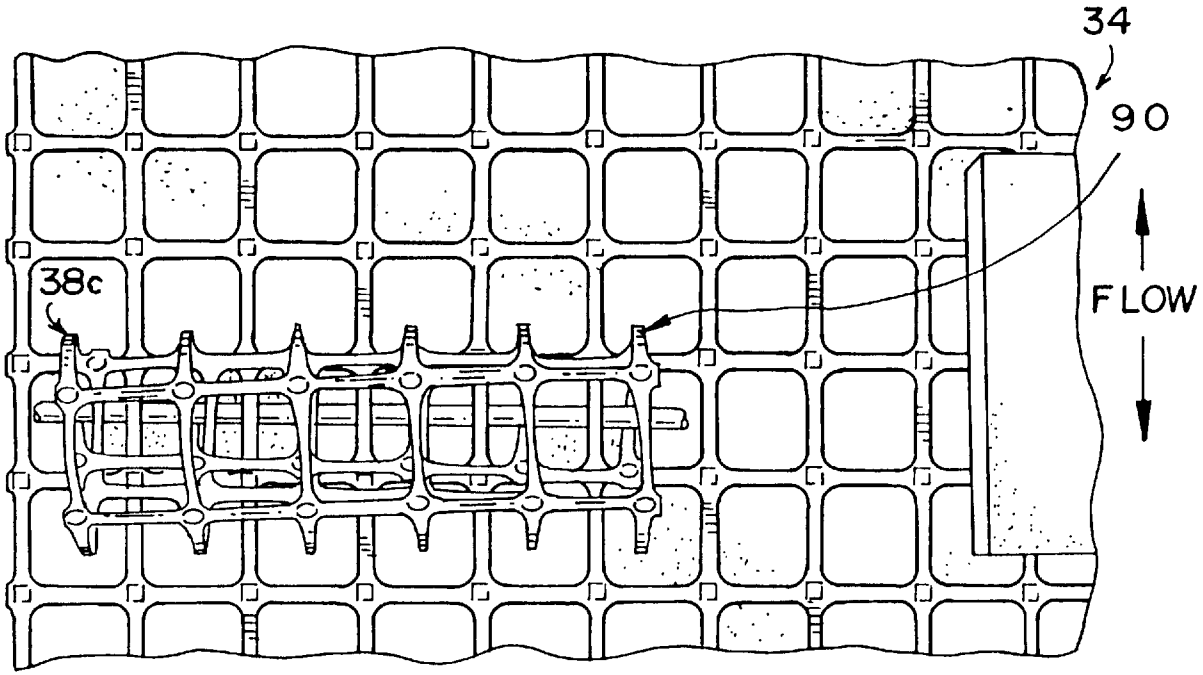
FIG. 9 is a plan view of yet another embodiment of connector element formed as a hoop of a biaxially oriented integral structural geogrid material secured to a geocomposite matrix by a single bodkin connector bar.

In FIGS. 9 and 10, a modified connector element 38*c* comprises a biaxial geogrid material 84 formed into a circular hoop 90. The opposed ends 92 and 94 of the geogrid 84 project above the upper surface of the geocomposite matrix 34 with strands of both ends of the connector element 38*b* projecting through the geogrid 52 of the matrix at the same location so that a single connector bar 96 may be used to hold the connector element 38*b* in place. The connector element 38*b* may be slightly compressed, if necessary, prior to block casting so that it is below the overall height of a concrete block 28 to be cast in place on the geocomposite matrix 34. In this embodiment, the hoop 90 defines an internal cavity 98 for reception of concrete or the like which amplifies the integration of the block-forming material with the connector element and improves the interengagement of the block 28 with the matrix 34.

Figure 11:
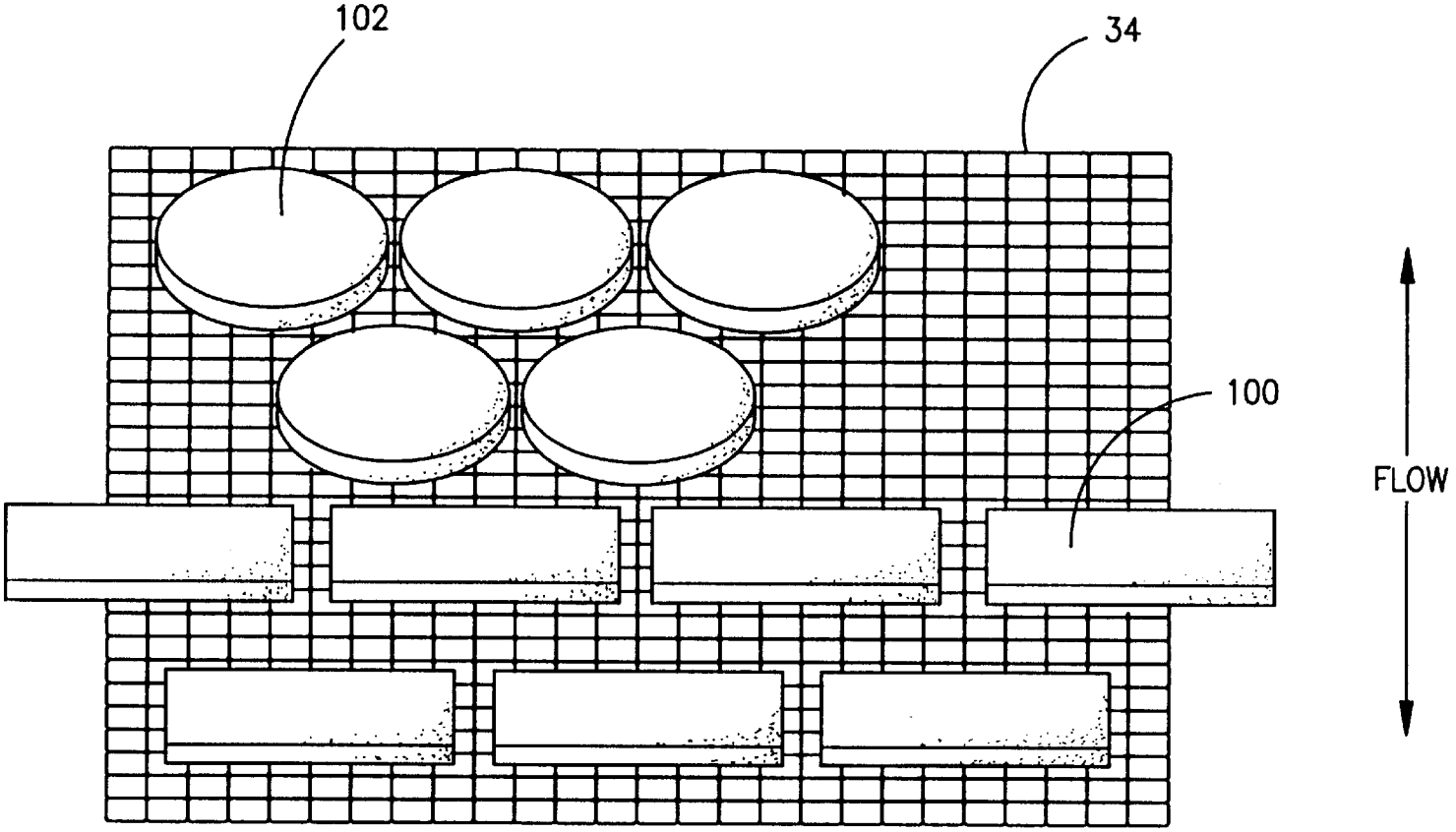
FIG. 11 is a perspective view illustrating the concept of staggering the concrete blocks on the underlying sheet matrix in a direction perpendicular to the flow of water in use and aligning the blocks in the opposite direction to provide bending gaps, both rectangular and circular blocks being shown on the same matrix merely for illustrative simplicity.

To illustrate the preferred arrangement of the blocks on the matrix, a plurality of rectangular blocks 100 and circular blocks 102 are shown on a single geocomposite matrix 34 in FIG. 11. It is understood that in use, the block system of the present invention will generally include all rectangular blocks or all circular blocks, or blocks of other geometries, but, in any event, alternate rows of blocks will be staggered as seen in FIG. 11 to provide lifting gaps between the rows and to interrupt water flow perpendicularly to the lifting gaps.

Figure 12A:
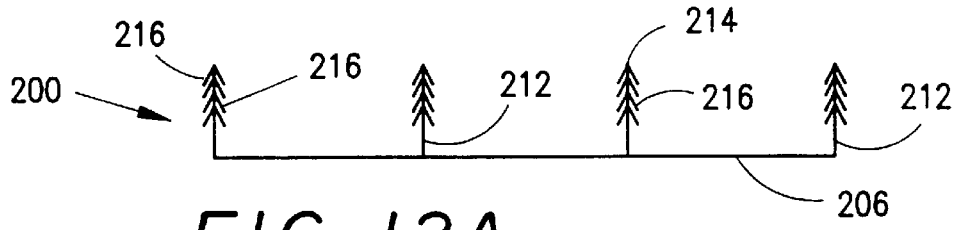
FIGS. 12A through 12C are schematic side elevational views of three connector strips for securing concrete blocks to a matrix according to another embodiment of the instant inventive concepts without need for the concrete to pass through the matrix material.
Figure 12B:
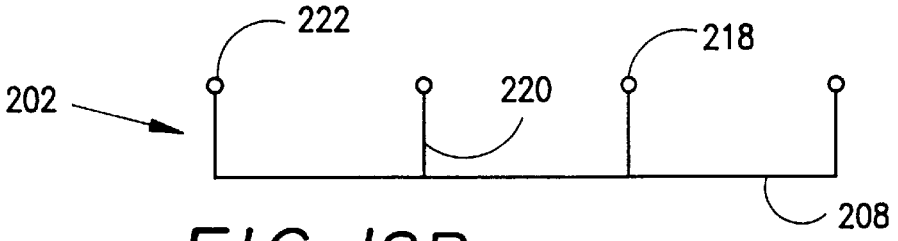
Figure 12C:
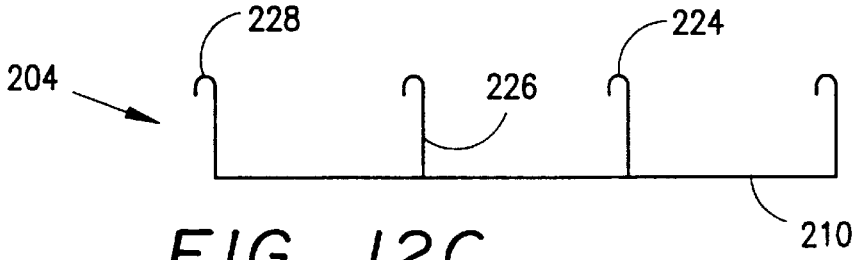

As an alternative to the connectors shown in FIGS. 2 through 10, a strip connector as shown in FIGS. 12A, 12B, or 12C may be used. The strip connector 200 shown in FIG. 12A, strip connector 202 shown in FIG. 12B and strip connector 204 shown in FIG. 12C, each include a base or mat 206, 208, 210, respectively. The base may be made of plastic or other semi-rigid material and be of an overall length less than the block member which is to be secured to the matrix.

With respect to strip connector 200, a plurality of vertically-extending fingers 212 extend perpendicular to the base layer 206. At the free end 214 of the fingers 212 a plurality of barbs 216 are provided, extending towards base layer 206 at an angle with respect to the main shaft of fingers 212. Similarly, in strip connector 202, at the free end 218 of each of the fingers 220 is located a ball or enlargement 222. In strip connector 204, the free end 224 of the fingers 228 includes a hook-shaped terminal portion 226 which curves around from the finger 226 in a direction back towards the base layer 210.

The number of fingers in each strip connector may be more or less than that shown in FIGS. 12A through 12C. It is only essential that the number of fingers is sufficient to retain a block member cast thereon and secure the same to the underlying matrix. Likewise, while specific formations in the nature of barbs, balls and hooks on the free ends of the fingers are shown herein as illustrative, it is only important that the fingers be provided with means to insure that the block-forming material will not readily separate therefrom. Thus, other formations adapted to insure capture and secure engagement of the connector elements with the block-forming material, including even apertures through the fingers (not shown) can be substituted for the illustrated formations.

Figure 13:
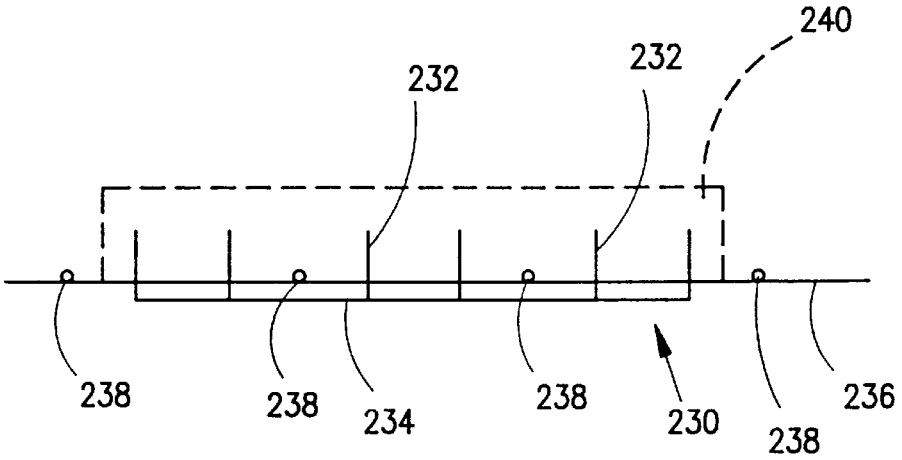
FIG. 13 is a schematic elevational view of a generic connector strip, representative of one of the specific connector strips in FIGS. 12A through 12C, with the fingers of the connector strip projecting through a matrix and into a concrete block (shown in phantom).

In FIG. 13, a strip connector 230 is shown as including fingers 232 projecting through a matrix material layer 236 with pairs of fingers extending between each bar 238 of the geogrid forming part of the matrix. It is understood that the strip connector 230 may have multiple rows of fingers 232, although only a single row is shown for illustrative purposes. The matrix 236 may be simply formed of a geogrid or it may be a geocomposite including a geogrid or the like bonded to a geotextile. The preferred use of a geocomposite facilitates engagement of the strip connector with the matrix, particularly during the block-casting procedure, because the geotextile surrounds and thereby retains the fingers in position.

As was explained with respect to the previous embodiments, a block member 240, shown in phantom, is cast upon the matrix 236 so as to engage and surround the portions of the fingers 232 extending above the matrix 236.

Figure 14:
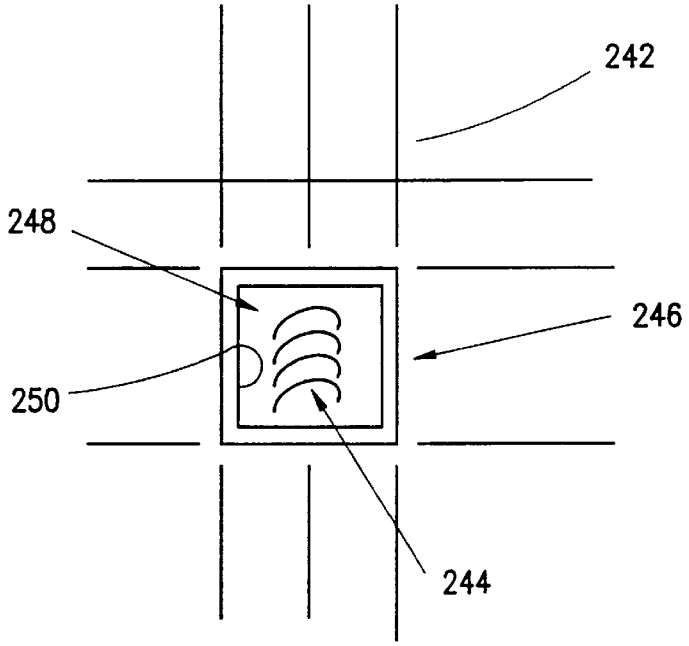
FIG. 14 is a plan view of a casting form located on top of a grid composite and surrounding a connector "sled".
Figure 15:
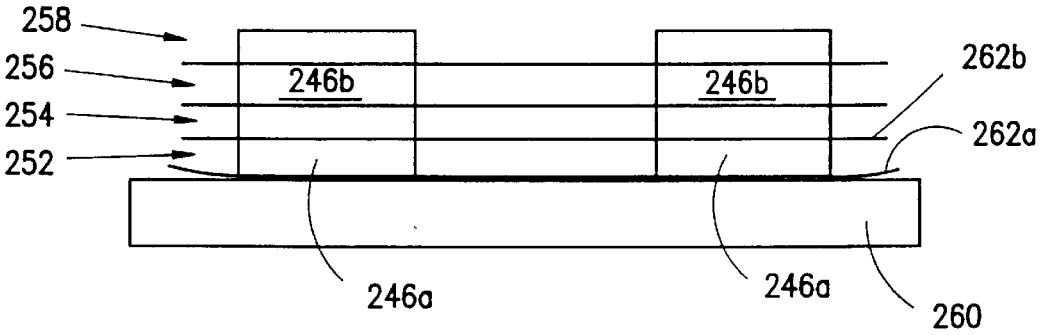
FIG. 15 is a schematic elevational view of a plurality of layers of grid composite mounted between casting forms for casting of several block systems in a limited space, and in the example shown, on a truck bed or barge.

In FIGS. 14 and 15, a preferred casting arrangement for forming block members on top of an underlying sheet material matrix 242 is illustrated. A connector 244 is anchored to the matrix 242. The connector 244 may be of the type shown in FIGS. 2 through 10 or of the type shown in FIGS. 12A through 13. In this embodiment, a pre-fabricated form or mold 246, in the shape of the to-be-formed block member, is placed about the connector 244. The mold may be made, for example, of a unitary piece of dried cast concrete, stiffened thermoplastic plastic, stiff thermoset plastic or brick. The mold 246 is intended to remain permanently in place when the mold is filled with concrete 248, or the like, the concrete adhering to the connector 244 as well as the interior wall 250 of the mold 246. The mold would then become a unitary piece with the to-be-formed block member.

By the use of a stiff mold member, it is possible to cast a plurality of layers 252, 254, 256 258 as shown in FIG. 15, in a limited space, such as a truck bed or barge 260. Initially, in layer 252, matrix 262*a* will include a plurality of the mold members 246*a* surrounding a connector (not shown). Concrete is then poured into the mold members 246*a*. While the concrete of layer 252 is curing, a second matrix 262*b* is placed across the first layer 252 and new mold members 246*b* are stacked on top of the mold members 246*a* of the first layer 252. The rigidity of the mold members 246*a* in the first layer is sufficient to support the mold members in the second layer so that a second pouring of concrete can be made while the concrete in the first layer is curing. This process is repeated for layers 256 and 258 until a desired number of layers of matrix material with block members is achieved.

Figure 16:
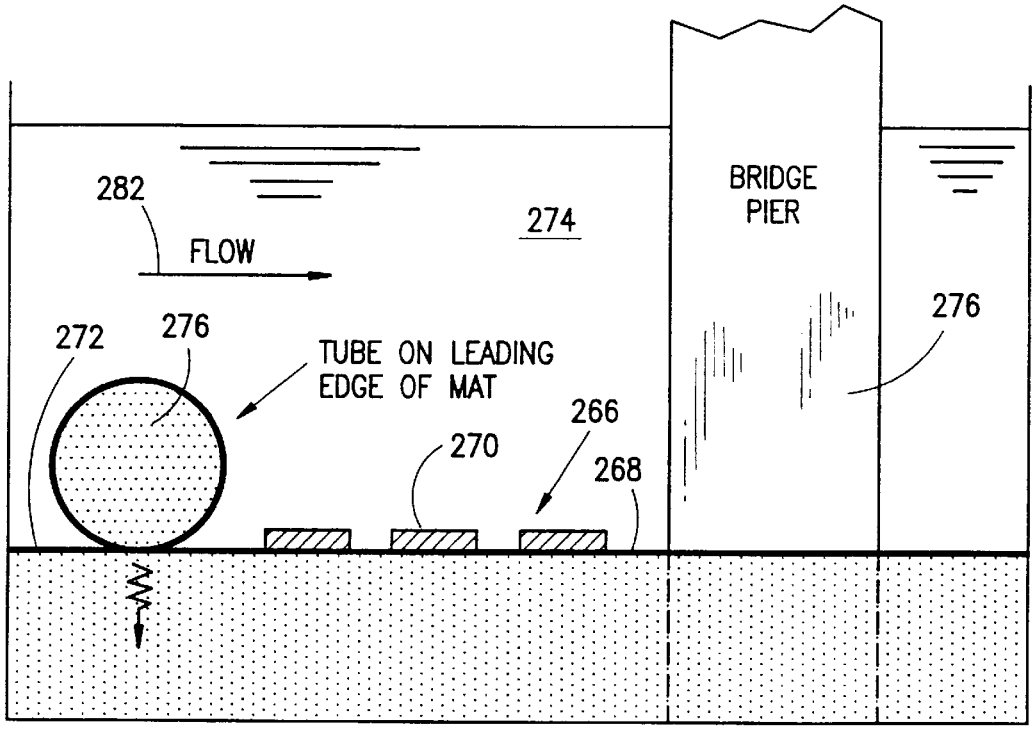
FIG. 16 is a schematic illustration of an interconnected block system located under water adjacent to a bridge pier with an anchoring tube secured to a leading edge of the block system.
Figure 17:
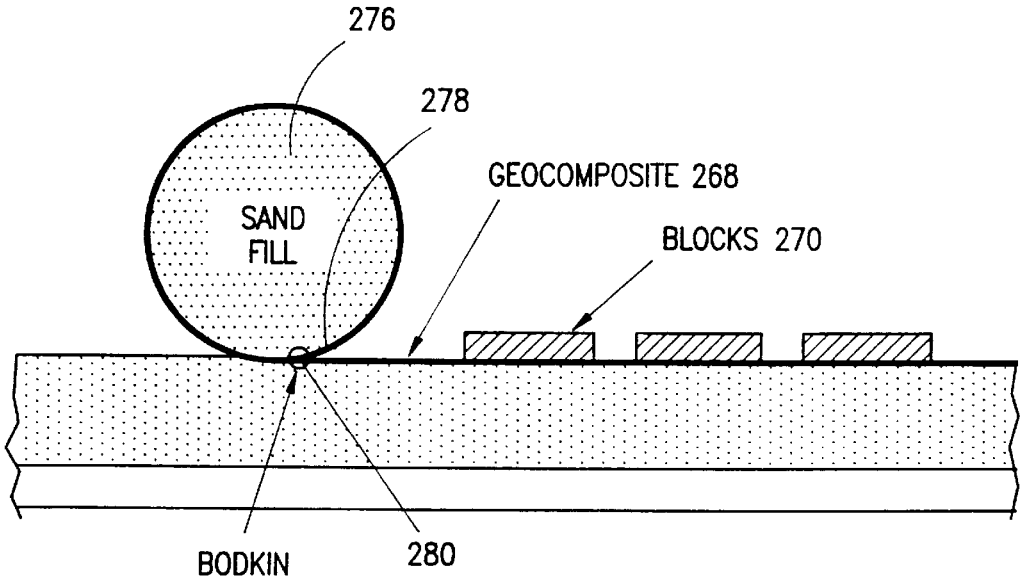
FIG. 17 is an enlarged detailed view of the connection of the sand tube shown in FIG. 16 to the leading edge of the block system.

In FIGS. 16 and 17, an interconnected block system 266 including a matrix 268 and plurality of block members 270 is shown located on the floor 272 of a waterway 274. The interconnected block system is positioned adjacent to a pier 276 so as to limit the erosion about the base of the pier.

As is known in the use of cable-tied blocks and grout mats, failure of these under water systems occurs by the overturning and rolling up at the leading edge of the mat if the mat is not adequately anchored or toed in. In addition, at high water velocities, if the leading edge is not adequately anchored, an uplift of the inner portion of the mat can occur.

To overcome these problems, it is contemplated as being within the scope of the present invention to use a woven geotextile tube 276 which is a closed tube with ports for injecting a sand/water slurry. To anchor the tube 276 to the block system 266 of the present invention as shown in FIG. 16 and as shown in greater detail in FIG. 17, a leading edge 276 of the matrix 268 is extended around the tube 276 and secured to itself by a bodkin type of mechanical connection using a connection or bodkin bar 280 which passes through the loops beneath the grid-like material of the matrix 268.

Alternatively, a section of matrix can surround the tube 276 and be secured to itself as well as to a leading edge portion of the matrix of the block system by a bodkin-type mechanical connection to anchor the additional portion of matrix material to the block system 266. This will anchor the leading edge of the system against movement by water forces in the direction of arrow 282.

The foregoing description should be considered as illustrative only of the principles of the invention. Since numerous modifications and changes will readily occur to those skilled in the art, it is not desired to limit the invention to the exact construction and operation shown and described, and, accordingly, all suitable modifications and equivalents may be resorted to, falling within the scope of the invention.

We claim:

1. An interconnected block system comprising at least one sheet of matrix material having opposite surfaces, a plurality of block members secured to one of said surfaces of said matrix sheet in a predetermined pattern, and at least one connector element secured to said matrix sheet for each block member, said connector element comprising a grid-like material including interconnected strands defining a plurality of apertures with portions extending beyond said one surface of said matrix sheet and defining at least one opening spaced from said one surface, the material of said block member extending into said opening and surrounding said portions of said connector element.

2. The block system of claim 1, wherein said block members are formed of concrete.

3. The block system of claim 1, wherein said matrix material comprises a sheet of grid-like material comprising interconnected strands defining a plurality of apertures.

4. The block system of claim 3, wherein said grid-like material is an integral structural geogrid.

5. The block system of claim 4, wherein said geogrid is uniaxially oriented.

6. The block system of claim 4, wherein said geogrid is biaxially oriented.

7. The block system of claim 3, wherein said matrix material is a geocomposite including a geotextile bonded to the side of said grid-like sheet opposite said block members.

8. The block system of claim 7, wherein said geocomposite further comprises a double-sided drainage composite bonded to said grid-like sheet including a geonet bonded between a pair of geotextiles.

9. The block system of claim 1, wherein said portions of said connector elements together with said one surface of said matrix sheet together define a reservoir generally parallel to the one surface of said matrix sheet, said reservoir being substantially filled by the block-forming material.

10. The block system of claim 9, wherein said connector element is formed by a grid-like material comprising interconnected strands defining a multiplicity of apertures, said block-forming material passing through said apertures and surrounding the strands of said connector element.

11. An interconnected block system as claimed in claim 1, wherein said connector element comprises a strip of said grid-like material having spaced end portions, and said connector element is secured to said matrix sheet at said two end portions of said grid-like sheet to form an inverted U- or V-shaped member.

12. An interconnected block system as claimed in claim 11, wherein said end portions of said connector element are secured to said matrix sheet by bodkin connections.

13. An interconnected block system comprising at least one sheet of matrix material having opposite surfaces, a plurality of block members secured to one of said surfaces of said matrix sheet in a predetermined pattern, at least one connector element secured to said matrix sheet for each block member, said connector element including portions extending beyond said one surface of said matrix sheet and defining at least one opening spaced from said one surface, the material of said block member extending into said opening and surrounding said portions of said connector element, said portions of said connector elements together with said one surface of said matrix sheet together defining a reservoir generally parallel to said one surface of said matrix sheet, said reservoir being substantially filled by the block-forming material, said connector element being formed by a grid-like material comprising interconnected strands defining a multiplicity of apertures, said block-forming material passing through said apertures and surrounding the strands of said connector element, said connector element being secured to said matrix sheet by at least one bodkin connection.

14. An interconnected block system comprising at least one sheet of matrix material having opposite surfaces, a plurality of block members secured to one of said surfaces of said matrix sheet in a predetermined pattern, and at least one connector element secured to said matrix sheet for each block member, said connector element including portions extending beyond said one surface of said matrix sheet and defining at least one opening spaced from said one surface, the material of said block member extending into said opening and surrounding said portions of said connector element, said connector element including a hoop of a sheet material secured to said matrix sheet and defining a reservoir generally parallel to said one surface of said matrix sheet, said reservoir being substantially filled by the block-forming material.

15. The block system of claim 14, wherein said connector element is formed by a grid-like material comprising interconnected strands defining a multiplicity of apertures, said block-forming material passing through said apertures and surrounding the strands of said connector element.

16. The block system of claim 15, wherein said connector element is secured to said matrix sheet by at least one bodkin connection.

17. An interconnected block system comprising:

at least one grid-like sheet of matrix material having opposite surfaces, a plurality of parallel rows of spaced block members carried by one of said surfaces of said matrix sheet, and a connector element secured to and projecting from said one surface of said matrix sheet for each block member, said connector elements each defining at least one opening, and the material of said block members being engaged in the openings of said connector elements so that said block members are mechanically anchored to said one surface of said matrix sheet, said connector element being formed by a sheet of grid-like material comprising interconnected strands defining a plurality of apertures and having spaced end portions, said connector element being secured to said matrix sheet at said spaced end portions to form a U- or V-shaped member.

18. An interconnected block system as claimed in claim 17, wherein the block members in adjacent rows are staggered by about 50%.

19. An interconnected block system comprising at least one sheet of matrix material having opposite surfaces, a plurality of block members secured to one of said surfaces of said matrix sheet in a predetermined pattern, at least one connector element secured to said matrix sheet for each block member, said connector element including portions extending beyond said one surface of said matrix sheet and defining at least one opening spaced from said one surface, the material of said block member extending into said opening and surrounding said portions of said connector element, said connector element defining a hoop member secured to said matrix sheet.

20. An interconnected block system as claimed in claim 19, wherein said connector element comprises a strip of grid-like material having spaced end portions, said strip of grid-like material being bent to form said hoop member and said end portions being secured to said matrix sheet by a bodkin connector.

21. An interconnected block system comprising at least one sheet of matrix material having a first surface and a second surface, a plurality of block members secured to said first surface of said matrix sheet in a predetermined pattern, and at least one connector element for each block member, each connector element including a sheet-like base member having a first surface and a second surface, said base member of said connector element being no larger in area than its associated block member, said first surface of said base member being juxtaposed to said second surface of said matrix sheet, a plurality of projections extending from said first surface of said base member in spaced relationship to each other and passing through said matrix sheet, said projections including portions extending beyond said first surface of said matrix sheet and mechanically anchored within their associated block member.

22. The block system of claim 21, wherein said block members are formed of concrete.

23. The block system of claim 21, wherein said matrix material includes a grid-like sheet defining apertures through which said projections pass.

24. The block system of claim 23, wherein said grid-like sheet comprises interconnected strands defining said apertures.

25. The block system of claim 24, wherein said grid-like sheet is an integral structural geogrid.

26. The block system of claim 25, wherein said geogrid is uniaxially oriented.

27. The block system of claim 25, wherein said geogrid is biaxially oriented.

28. The block system of claim 23, wherein said matrix material comprises a geocomposite including a geotextile and said grid-like sheet.

29. The block system of claim 28, wherein said geocomposite further comprises a double-sided drainage composite bonded to said grid-like sheet including a geonet bonded between a pair of geotextiles.

30. The block system of claim 21, comprising a plurality of parallel rows of spaced block members secured to said first surface of said matrix sheet, the blocks in alternate rows being staggered relative to each other.

31. An interconnected block system as claimed in claim 30, wherein the block members in adjacent rows are staggered by about 50%.

32. An interconnected block system comprising:

at least one sheet of matrix material, a plurality of block members secured to said matrix sheet in a predetermined pattern, a weighted tube for anchoring a leading edge of said matrix material against water forces moving said matrix material, and a sleeve secured to said leading edge of said matrix material, said sleeve surrounding said tube and being a portion of said matrix material.

33. A method of forming an interconnected block system, said method comprising:

providing at least one grid-like sheet of matrix material, securing a plurality of connector elements to said matrix sheet with portions of each connector element defining at least one opening extending beyond one surface of said matrix sheet, and casting a block member around each of said connector elements with the material of said block members filling said openings to secure said block members to the top surface of said matrix sheet, said matrix sheet including an integral structural polymer geogrid, said connector element being formed of a grid-like sheet material portions of which are connected to said geogrid, and said connector element being connected to said matrix sheet by at least one bodkin connection.

34. A method as claimed in claim 33, wherein said matrix sheet comprises a geocomposite including a sheet of geogrid bonded to a geotextile.

35. A method as claimed in claim 34, wherein said geocomposite comprises a geogrid bonded to a drainage composite including a geonet sandwiched between sheets of geotextile.

36. A method of forming an interconnected block system, said method comprising:

providing at least one sheet of matrix material having a first surface and a second surface, providing at least one connector element for each block member including a sheet-like base member having a first surface and a second surface, said base member of said connector element being no larger in area than its associated block member, a plurality of projections extending from said first surface of said base member in spaced relationship to each other, said projections including free end portions configured to mechanically anchor said block members, positioning each connector element in engagement with said matrix sheet such that said first surface of said base member is juxtaposed to said second surface of said matrix sheet and said free end portions of said projections project through said matrix sheet and extend beyond said upper surface of said matrix sheet, and casting a block member about said free end portions of said connector elements to secure said block members to said first surface of said matrix sheet.

37. A method as claimed in claim 36, wherein said matrix sheet includes an integral structural polymer geogrid.

38. A method as claimed in claim 36, wherein said matrix sheet comprises a geocomposite including a sheet of geogrid bonded to a geotextile.

39. A method as claimed in claim 38, wherein said geocomposite comprises a geogrid bonded to a drainage composite including a geonet sandwiched between sheets of geotextile.

40. A method of forming an interconnected block system, said method comprising:

providing at least one sheet of matrix material including an upper surface and a lower surface, engaging a plurality of connector elements with said matrix sheet with portions of said connector elements extending above said upper surface of said matrix sheet, placing a preformed mold around each of said connector elements, and casting a block member around said portions of each of said connector elements by filling said mold with a block-forming material to secure said block members and said mold to said upper surface of said matrix sheet, leaving said mold in position surrounding said block-forming material, further comprising placing at least one additional sheet of matrix material over said filled molds before said block-forming is set with said lower surface of said additional sheet of matrix material resting on said filled molds, engaging a plurality of additional connector elements with said additional matrix sheet, placing additional molds around each of said additional connector elements, resting said additional molds on molds therebelow, and filling said additional molds with additional block-forming material.

41. A method as claimed in claim 40, wherein said block-forming material is concrete.

* * * * *